US010604395B1

(12) United States Patent
Yesnick et al.

(10) Patent No.: US 10,604,395 B1
(45) Date of Patent: Mar. 31, 2020

(54) FUNNEL

(71) Applicant: MOC PRODUCTS COMPANY, INC., Pacoima, CA (US)

(72) Inventors: Charles Yesnick, Rolling Hills, CA (US); Sheldon Holland, Acton, CA (US)

( * ) Notice: Subject to any disclaimer, the term of this patent is extended or adjusted under 35 U.S.C. 154(b) by 0 days.

(21) Appl. No.: 16/151,551

(22) Filed: Oct. 4, 2018

(51) Int. Cl.
*B67C 11/04* (2006.01)
*B67C 11/00* (2006.01)
*B67C 9/00* (2006.01)

(52) U.S. Cl.
CPC ..... *B67C 11/00* (2013.01); *B67C 9/00* (2013.01); *B67C 11/04* (2013.01)

(58) Field of Classification Search
CPC B67C 9/00; B67C 11/00; B67C 11/02; B67C 2011/027; B67B 7/28
USPC ..... 141/319, 331–345
See application file for complete search history.

(56) References Cited

U.S. PATENT DOCUMENTS 1,997,888 A * 4/1935 Sexton ..... G01F 19/00 222/83.5
3,643,704 A * 2/1972 Carr ..... B65B 3/06 141/106
4,832,095 A * 5/1989 Bonnell ..... B65D 71/502 141/106
4,832,238 A * 5/1989 Taylor ..... B65D 25/48 141/337
5,325,898 A * 7/1994 Forgnone ..... B67C 9/00 141/106
5,385,180 A * 1/1995 Wittman ..... B67C 11/02 141/106
6,340,038 B1 * 1/2002 Ingram ..... B67C 11/02 141/333
6,758,308 B1 * 7/2004 Hearting ..... B67C 11/02 141/331
6,962,174 B1 * 11/2005 Trantham ..... B08B 9/08 141/106
7,114,536 B2 * 10/2006 Guthrie ..... F16L 11/15 141/337
2006/0108022 A1 * 5/2006 Carter ..... B65B 39/12 141/340
2012/0199244 A1 * 8/2012 James ..... G07F 9/105 141/331
2015/0274499 A1 * 10/2015 Simpson ..... B67C 11/02 141/332

* cited by examiner

*Primary Examiner* — Timothy L Maust
(74) *Attorney, Agent, or Firm* — Fulwider Patton LLP

(57) ABSTRACT

A funnel is disclosed having an oil bottle securing portion and an adjustable conduit portion. The oil bottle securing portion is an open housing with converging side walls, and an end wall including a bottle securing rectangular groove along an upper edge. Seated within the open housing is a U-shaped stop that receives and abuts the top of a standard oil bottle, such that the neck of the oil bottle passes through the U-shaped stop but the shoulder of the bottle abuts the U-shaped stop. With a lower portion of the oil bottle disposed within the rectangular groove of the end wall and the neck of the oil bottle passing through the U-shaped stop, the oil from the bottle will empty into a frusto-conical reservoir at a first end of the funnel on the opposite side of the U-shaped stop and pass through the adjustable conduit.

6 Claims, 4 Drawing Sheets

FUNNEL

BACKGROUND

The present invention relates generally to funnels used with vehicles, and more specifically to an oil funnel for use with motorcycles.

Funnels used with automobiles have been around for decades. They are typically conical and allow oil to be poured directly from an oil container to the vehicle's crankcase. The conical funnel with its narrow spout allows the oil to be introduced into any top facing orifice designated for this purpose. This requires that the user hold both the funnel and the oil container until it completely empties, which can be tedious with such a viscous fluid.

Motorcycles have their own unique peculiarities when it comes to replenishing the oil for the combustion engine. The oil may be introduced either in a port that is not suited for a conical funnel, or there may be a specialized port that requires a particular fitting. The present invention is directed to the unique features of the motorcycle in connection with the oil replenishment operation.

SUMMARY OF THE INVENTION

The present invention is directed to a funnel having an oil bottle securing portion and an adjustable conduit portion. The oil bottle securing portion is an open housing with converging side walls, and an end wall including a bottle securing rectangular groove along an upper edge. A front wall may be larger than the side walls and serve as a splash guard, with a bowed outward construction that reduces splashing and rounded upper edge, and splash reducing slots to resist movement of the collection oil up the front wall. Seated within the open housing is a U-shaped stop with tapered outer edges that is adapted to receive and abut the top of a standard oil bottle, such that the neck of the oil bottle passes through the U-shaped stop but the shoulder of the bottle abuts the U-shaped stop. With a lower portion of the oil bottle disposed within the rectangular groove of the end wall and the neck of the oil bottle passing through the U-shaped stop, the oil from the bottle will empty into a frusto-conical reservoir at a first end of the funnel on the opposite side of the U-shaped stop. The upper edge of the rectangular groove is raised above the horizontal edge of the U-shaped stop so that the oil will completely drain into the frusto-conical reservoir.

The frusto-conical reservoir has an egress port at the lowermost surface adjacent a threaded coupling. The adjustable conduit portion has a first end that mates with the threaded coupling in a fluid tight seal, which preferably includes an O-ring. The adjustable conduit can be a flexible tubing, or it can be made up of individual segments or elements that permit limited flexure between the elements without leakage of the oil. One embodiment is a series of spherically-shaped interlocking components that can be arranged to retain a specific shape of the conduit. At the other end of the conduit is a coupling with a locking mechanism that can receive a check ball valve fitting or the like. This fitting mates with an oil port on the motorcycle to transfer the oil to the motorcycle in a leak-proof manner.

DETAILED DESCRIPTION OF THE PREFERRED EMBODIMENTS

Figure 1:
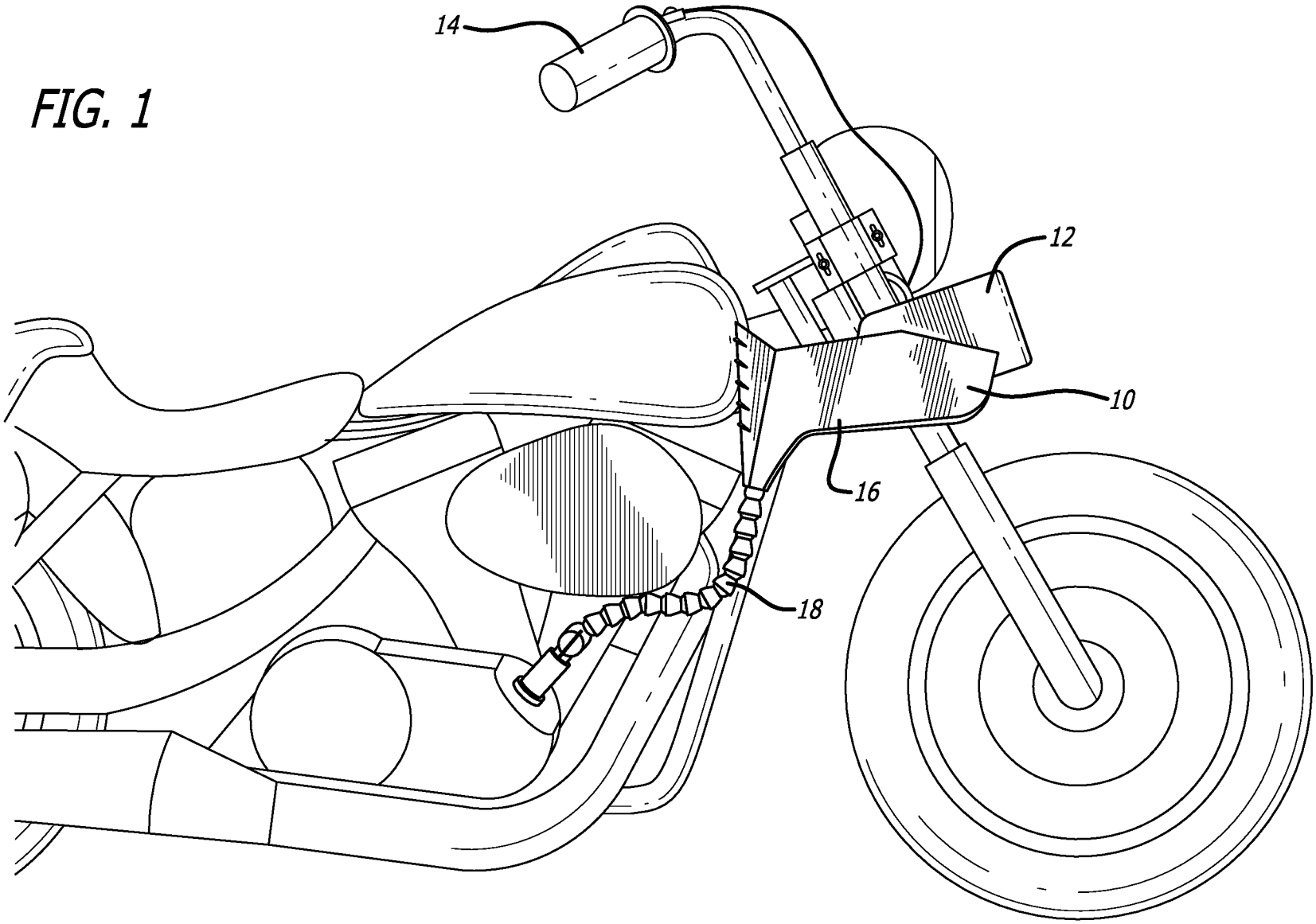
FIG. 1 a perspective view of a first preferred embodiment of the present invention.
Figure 2:
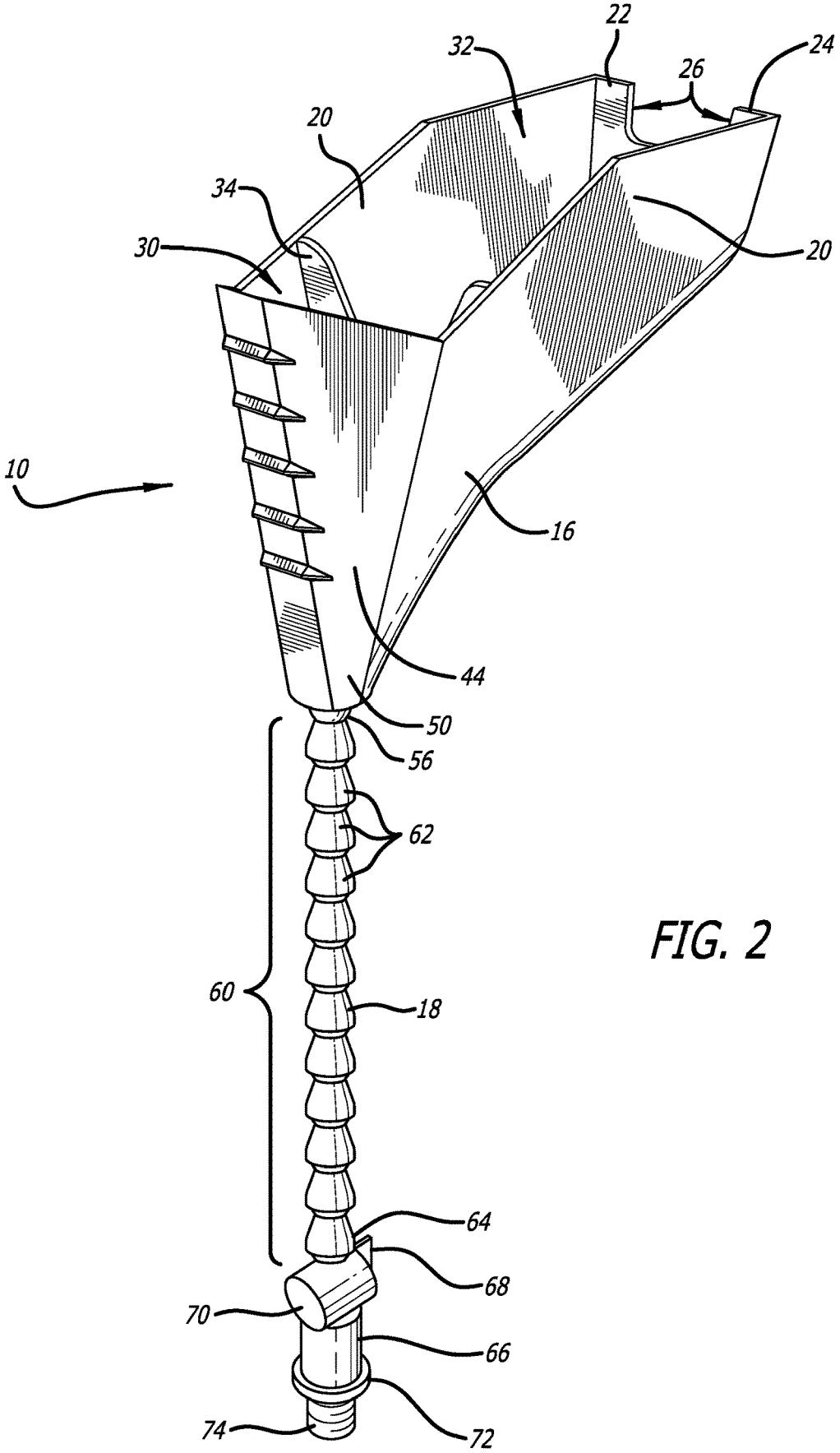
FIG. 2 is an enlarged, elevated perspective view of the embodiment of FIG. 1.
Figure 3:
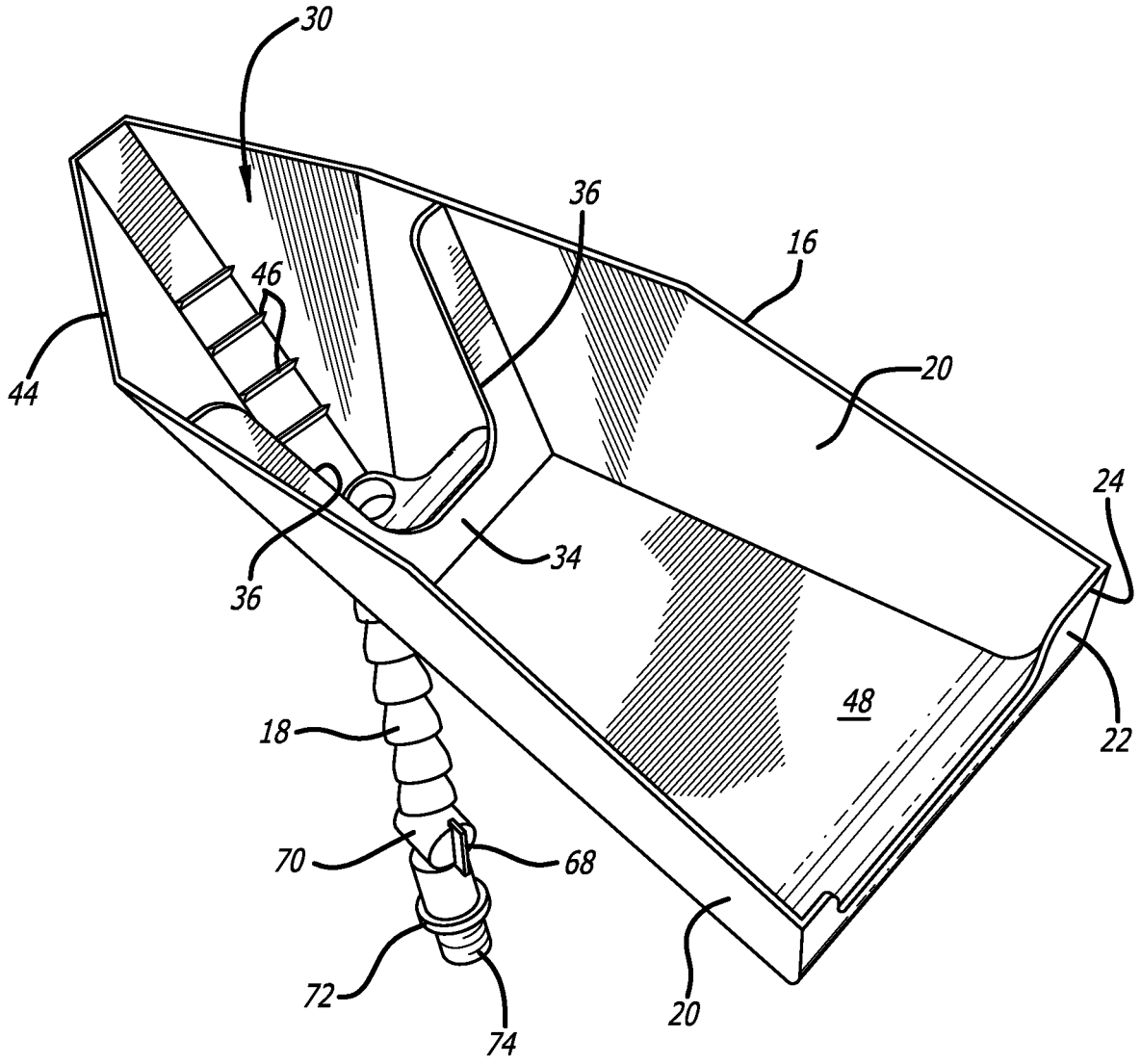
FIG. 3 is an enlarged, elevated top view of the embodiment of FIG. 1.
Figure 4:
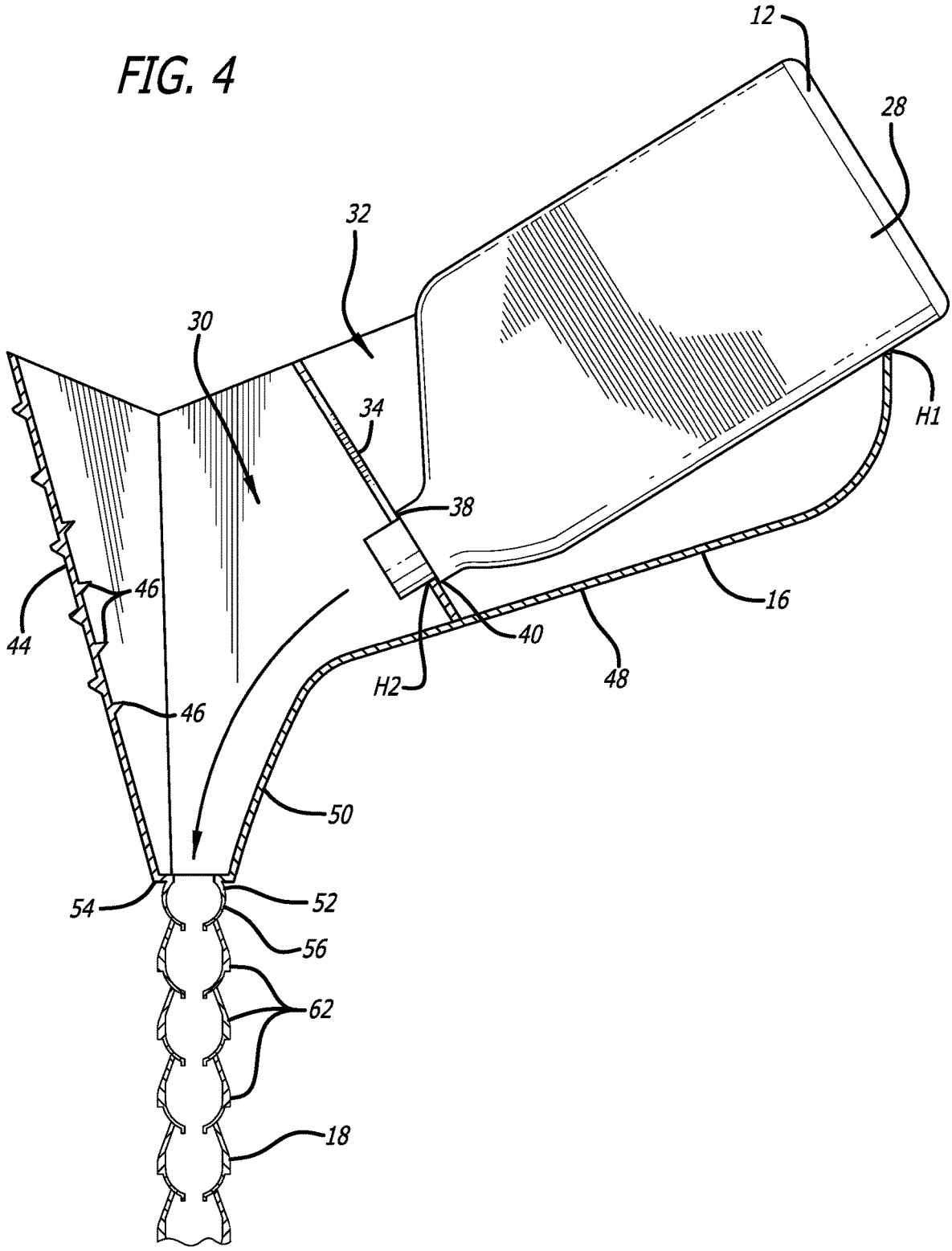
FIG. 4 is a cross sectional view of the embodiment of FIG. 1.

FIG. 1 illustrates a first preferred embodiment of the present invention, depicting a multi-position funnel 10 used to service vehicles and especially motorcycles 14. The funnel 10 cooperates with a standard quart oil bottle 12 to convey the contents of the oil bottle 12 to the vehicle 14. The funnel 10 has two components that may be detachable or integrally formed, namely an oil bottle securing element 16 and an adjustable conduit element 18. The oil bottle securing element 16 is an open housing with converging side walls 20 that may taper in a rearward direction. The side walls 20 terminate rearwardly at an outwardly angled end wall 22 having an upper edge 24 that includes a rectangular slot 26 sized to grip an oil bottle bottom portion 28. The interior of the open housing is divided into an oil collecting front portion 30 and an oil bottle retaining portion 32, separated by a U-shaped stop 34 seated within the open housing and forming a fluidic seal with the side walls 20 and the floor 48. The U-shaped stop 34 is formed with tapered outer edges 36 that are adapted to receive and abut a top 38 of a standard oil bottle 12, such that the neck 40 of the oil bottle 12 passes through the U-shaped stop 34 but the shoulder 42 of the bottle abuts the U-shaped stop 34.

The open housing further is formed with a front wall 44 enclosing the oil collecting front portion 30, where the front wall 44 is preferably taller than the side walls and serves as a splash guard. To this end, the front wall 44 is contoured so as to be bowed outward to better pool the collecting oil and to also reduce splashing, and incorporates splash reducing ledges or slots 46 vertically spaced along its height to slow oil movement up the front wall 44. The oil collecting front portion 30 preferably occupies a volume that is greater than a quart so as to hold the entire quart of oil from the bottle 12 prior to transfer of the oil to the vehicle. The floor 48, side walls 20, and front wall 44 coalesce into a frusto-conical drain 50 having a port 52 at the bottom edge 54. The port is preferably threaded and carries an O-ring to better seal the port 52. With a lower portion of the oil bottle disposed within the rectangular slot 26 of the end wall 22 and the neck 40 of the oil bottle 12 passing through the U-shaped stop 34, the oil from the bottle will empty into the frusto-conical drain 50 and pass through the port 52. The rectangular slot 26 has an elevation H1 that is greater than an elevation H2 of the horizontal edge 54 of the U-shaped stop 34 so that the oil in the bottle 12 will gravitationally flow out of the bottle and will completely transfer to the lower elevation frusto-conical drain 50.

The adjustable conduit 18 has a first end 56 that mates with the threaded port 52, and may comprise a locking Alan plug. The adjustable conduit 18 may have an inner diameter of one inch and a length of twelve inches, and form an adjustable tubing 60 that preferably can retain its shape once formed into a selected configuration. One example of an adjustable tubing is a conduit made up of individual segments 62 or elements that permit limited flexure between the elements without leakage of the oil. One embodiment is a series of oval-shaped interlocking components 62 that allow the entire tubing 60 to be arranged to retain a specific shape.

At the other end 64 of the conduit 60 is a coupling 66 with a locking mechanism 68 such as an Alan plug that can receive a closure device such as a check ball valve 70 or the like. The valve 70 may include an independent rotational oil plug 72 and an O-ring sealed, threaded insert 74. This valve component mates with an oil inlet port on the motorcycle 14 to transfer the oil to the motorcycle in a leak-proof manner.

While particular aspects of the present invention have been illustrated and described herein, the invention should not be interpreted as being confined to any image or characterization unless expressly so limited. Rather, a person of ordinary skill in the art would readily appreciate various modifications and substitutions to the foregoing described and depicted embodiments, and the present invention is intended to include all such modifications and substitutions. Accordingly, the scope of the present invention is properly measured by the appended claims using the customary and ordinary meanings of the terms used therein, and not confined to any specific embodiment illustrated herein.

We claim:

1. A funnel for use with a vehicle, comprising:

an oil bottle securing portion having first and second side walls terminating at an end wall, the end wall including an oil bottle retaining slot along an upper surface, the oil bottle securing portion further comprising a front wall having vertically spaced apart fluid motion deterring elements, and a frusto-conical drain;

a U-shaped stop positioned in the oil bottle securing portion adapted to receive an upper portion of an oil bottle when a lower portion of the oil bottle is retained by the retaining slot, and wherein a horizontal edge of the U-shaped stop is positioned higher in elevation than a horizontal edge of the slot;

a multi-position conduit coupled to the frusto-conical drain including a valve at a distal end.

2. The funnel of claim 1, wherein the front wall extends to an elevation higher than the first and second side walls and forms a compartment that holds one quart of fluid.

3. The funnel of claim 1, wherein the multi-position conduit comprises a plurality of oval shaped links that permit limited flexure between each pair of links.

4. The funnel of claim 1, wherein the multi-position conduit includes an Alan plug on each end.

5. The funnel of claim 1, wherein the first and second side walls are tapered in the rearward direction.

6. The funnel of claim 1, wherein the U-shaped stop forms a seal with the first and second side walls and a floor of the oil bottle securing portion.

* * * * *